US008979091B2

(12) United States Patent
Darragh

(10) Patent No.: US 8,979,091 B2
(45) Date of Patent: Mar. 17, 2015

(54) TETHERED BALL GAME

(71) Applicant: Sweetwater Ventures, LLC, Sweetwater, TN (US)

(72) Inventor: Harold Jeffers Darragh, Sweetwater, TN (US)

(73) Assignee: Sweetwater Ventures, LLC, Sweetwater, TN (US)

( * ) Notice: Subject to any disclaimer, the term of this patent is extended or adjusted under 35 U.S.C. 154(b) by 0 days.

(21) Appl. No.: 14/064,716

(22) Filed: Oct. 28, 2013

(65) Prior Publication Data

US 2014/0117621 A1 May 1, 2014

Related U.S. Application Data

(60) Provisional application No. 61/718,923, filed on Oct. 26, 2012.

(51) Int. Cl.

| | |
|---|---|
| ***A63B 63/00*** | (2006.01) |
| ***A63B 67/00*** | (2006.01) |
| ***A63B 67/06*** | (2006.01) |
| *A63B 43/00* | (2006.01) |

(52) U.S. Cl.

CPC ..... *A63B 67/06* (2013.01); *A63B 63/00* (2013.01); *A63B 43/007* (2013.01); *A63B 2067/063* (2013.01)

USPC ..... 273/343

(58) Field of Classification Search

CPC ..... A63B 63/00; A63B 67/00; A63B 67/002; A63B 67/06; A63B 2067/063

USPC ..... 273/343; 473/575, 576, 569; D21/302

See application file for complete search history.

(56) References Cited

U.S. PATENT DOCUMENTS

| | | | | | |
|---|---|---|---|---|---|
| 2,120,075 | A | * | 6/1938 | Roosman | 473/514 |
| 2,408,160 | A | * | 9/1946 | Brunner | 273/440 |
| 2,797,924 | A | * | 7/1957 | Stewart | 273/343 |
| 3,701,531 | A | * | 10/1972 | Bowers | 273/343 |
| 3,717,348 | A | * | 2/1973 | Bowers | 473/514 |
| 4,346,902 | A | | 8/1982 | Warehime | |
| 4,635,942 | A | | 1/1987 | Flaherty, Jr. | |
| 4,971,335 | A | | 11/1990 | Galvin | |
| 5,171,019 | A | | 12/1992 | Arnette | |
| 5,280,843 | A | * | 1/1994 | Vartija et al. | 473/576 |
| 5,294,129 | A | * | 3/1994 | Brown | 473/514 |
| 5,522,597 | A | * | 6/1996 | Hanks | 473/514 |
| 5,879,251 | A | * | 3/1999 | Rose | 473/576 |
| D423,057 | S | | 4/2000 | Mooney | |
| 6,308,956 | B1 | | 10/2001 | Reid | |
| 7,004,468 | B2 | | 2/2006 | Johnson et al. | |
| 7,134,661 | B2 | * | 11/2006 | Trecartin | 273/343 |
| 7,198,273 | B1 | | 4/2007 | Advocate | |
| 7,377,516 | B2 | * | 5/2008 | Vallee et al. | 273/343 |
| 7,703,771 | B2 | | 4/2010 | Hunt et al. | |
| D626,181 | S | | 10/2010 | Lima | |

(Continued)

*Primary Examiner* — Raleigh W Chiu

(74) *Attorney, Agent, or Firm* — Pitts & Lake, P.C.

(57) ABSTRACT

Embodiments of the present general inventive concept provide a game that includes two tethered balls and a goal post adapted to receive the tethered balls. In some embodiments, the goal post includes a vertical body configured to stand upright and an upwardly-angled appendage configured to allow the tethered balls to hang thereon. In some embodiments, the game includes two participants competing to place or toss the tethered balls on or at the goal post, such that the resulting arrangement resembles that of a male's genitalia.

16 Claims, 3 Drawing Sheets

(56) References Cited

U.S. PATENT DOCUMENTS

| | | | | |
|---|---|---|---|---|
| 8,011,664 | B2 | 9/2011 | Hilbert, Jr. et al. | |
| 8,128,093 | B1 | 3/2012 | Gerrish | |
| 2005/0134000 | A1 | 6/2005 | Johnson et al. | |
| 2008/0093803 | A1 | 4/2008 | Vallee et al. | |
| 2008/0224408 | A1 | 9/2008 | Eisenbarth | |
| 2009/0206550 | A1 | 8/2009 | Pershin et al. | |
| 2014/0117621 | A1* | 5/2014 | Darragh | 273/343 |

* cited by examiner

TETHERED BALL GAME

CROSS-REFERENCE TO RELATED APPLICATIONS

This Application claims the benefit under 35 U.S.C. section 119(e) of U.S. Provisional Patent Application Ser. No. 61/718,923, filed Oct. 26, 2012.

FIELD OF INVENTION

The present inventive concept relates generally to the field of games, and more particularly to a game that involves the placement of two balls or like objects tethered to one another onto a goal post such that when the two tethered objects are successfully placed on said goal post, the resulting arrangement resembles a male's genitalia.

BACKGROUND

Games that involve placing or tossing an article on or at another object have long been known in the art. For example, horseshoes involves participants tossing metal horseshoes at a stake installed in the ground. Washers, ladder golf, bags, and many more games have further adapted this basic concept, particularly with an eye toward portability so that individuals may play these games at tailgates, barbeques, etc.

Some such games are known in the patent literature. By way of example, U.S. Pat. No. 4,346,902, issued to Warehime, discloses a handball type game and apparatus for singles and doubles play on permanent or temporary type court layout utilizing a pair of special tethered balls of convenient hand size and with high rebound characteristics. Balls are connected by cord with small swivel therein, with spacing between balls roughly approximating shoulder width of wide range of users. Simple measuring and marking means facilitates court layout. Also, existing regular handball, racquetball, and squash courts can be used for game play, however, only one vertical wall is used in novel game. Basic game rules require tethered balls to be thrown one-handedly, that is, both balls released from one hand, and caught on rebound from wall two-handedly, that is, one ball each caught separately and simultaneously. Fault assessments and scoring awards are somewhat similar to regular handball. The paired tethered balls also have many other exercise, recreational, and entertainment uses for a wide range of participants.

U.S. Pat. No. 4,971,335, issued to Galvin, discloses a game/toy device generally comprises a cord which is fastened to two spaced apart support posts that are vertically mounted from the ground. An alarm or bell device(s) is connected or attached to said cord. The user/player may score a point by tossing a ball or other object at the cord and hitting it. The alarm/bell device signals each point made. A selected number of hits wins the game.

U.S. Pat. No. 5,171,019, issued to Arnette, discloses a tethered ring game and kit comprising a tethered ring, means for attaching the tether to an overhanging surface, swivel means mounted intermediate the tether and the attachment means for preventing the cord from becoming twisted during use, and an open hook to be mounted on a surface approximately 90 spaced relation to the attachment means for receiving the tethered ring.

U.S. Pat. No. 6,308,956, issued to Reid, discloses a tethered ball toss game is described in which a number of tethered balls arranged at both ends of a series of cords and secured to the ends of the cords by knots are tossed from a prescribed distance toward a number of horizontal bars positioned between upright supports which are retained in perpendicular angularity to the underlying support surface by bottom supports. Each of the horizontal bars are relocatable in a vertical direction along the side supports to other predetermined points for engagement with the side supports by engaging a retractable latching member into a cooperating hole so that the bar is secured in the desired position. In this fashion the distance between the bars can be altered to vary the difficulty and skill levels of the game. Alternative embodiments of the game are also contemplated where the length of the bars is varied by changing the shape of the side supports to accommodate shortened horizontal bars. This different array of bars can be progressively shorter from bottom to top, or vice versa, or have shorter bars at the middle of the vertical distance.

U.S. Pat. No. 7,004,468, issued to Johnson et al., discloses a game including a frame, a rotatable scoring assembly, and at least one playing piece. The at least one playing piece is thrown toward the rotatable scoring assembly, and points are scored by the playing piece coming to rest on predetermined portions of the scoring bar assembly.

U.S. Pat. No. 7,703,771, issued to Ray M. Hunt and Anne Hunt, discloses a game in which two spherical balls tethered to opposing ends of a flexible cord are tossed at a ladder-like target goal post having a plurality of cross bars, the toss occurring from the region behind a facing goal post spaced across a field of play. An objective of the game is to toss the tethered ball pair across the field to the opposing goal post to entwine or wrap around a goal post cross bar. Points are earned when the toss remains wrapped to the crossbar.

U.S. Pat. No. 8,128,093, issued to Gerrish, discloses a game that includes a plurality of stringed ball assemblies and a frame including a series of rotatable arms located thereon. The stringed ball assemblies each consist of two balls each secured to an end of a string, and a middle ball having a hole bored there through and of which said string is threaded thereon such that the middle ball can traverse back and forth along said string and in between the two balls located at each end. The frame supports the rotatable arm across a central arm such that the rotatable arms rotate along a horizontal axis. The rotatable arms and the central arm are each color-coded and upon landing a stringed ball assembly shall award a point designated by the rules of the game. The stringed ball assemblies can impact or land upon the rotatable arms, which may cause the rotatable arms to rotate about the horizontal axis via bearings affixed between the rotatable arms and the central arm.

U.S. Patent Application Publication 2008/0093803, filed by Vallee et al., discloses ball tossing game consists of a tossing device that is thrown at a target device. The tossing device may consist of a string or other flexible connector, having a ball on each end thereof. The target has at least one and preferably multiple horizontally-oriented rungs, onto which the tossing device may be wrapped. Additional targets are provided, including a target defined by a vertically oriented post positioned proximate an end of a horizontal rung and perpendicular thereto. In another embodiment, a reduced-length horizontal rung is coupled to at least one of the rungs, and is oriented either above or below the rung. It may be desired to provide, for a single rung, vertically oriented posts and at least one reduced-length horizontal rung.

U.S. Patent Application Publication 2009/0206550, filed by Pershin et al., discloses a hook and ring game apparatus and method including a hook device having a mounting portion with a longitudinal axis substantially transverse to a surface. The hook device further including an arcuate portion extending from the mounting portion forming a sweep of about one-hundred and eighty degrees terminating in a cantilever beam having an acute angle to the surface. Further included is a ring assembly having a tether with a first end portion freely suspended from a selected position in an overhead support and a second end portion adjacent to a ring being operational to freely swing a pendulum type of movement relative to the overhead support. The ring and hook are operational to form a chance element to removably engage one another as the ring moves through the arc path potentially contacting with the hook, with either the ring removably engaging the hook or not engaging the hook.

Notwithstanding the wide array of products available, Applicant is unaware of any game that incorporates structures that resemble male genitalia. Accordingly, there exists a need in the art for a game that includes the placing or tossing of objects coupled together on or at a pole or like appendage such that a successful placing or toss results in an arrangement that resembles male genitalia.

BRIEF SUMMARY

Embodiments of the present general inventive concept provide a game that includes two tethered balls and a goal post adapted to receive the tethered balls. In some embodiments, the goal post includes a vertical body configured to stand upright and an upwardly-angled appendage configured to allow the tethered balls to hang thereon. In some embodiments, the game includes two participants competing to place or toss the tethered balls on or at the goal post, such that the resulting arrangement resembles that of a male's genitalia.

In some embodiments of the present general inventive concept, a game includes a pair of substantially round objects joined together with a tether, a vertical body configured to stand upright on a substantially flat surface, and a projecting appendage disposed between a top and a bottom of said vertical body, said vertical body and said projecting appendage cooperating to receive the tether joining together the pair of substantially round objects, such that when said vertical body and said projecting appendage have received the tether joining together the pair of substantially round objects, a portion of the tether rests upon the projecting appendage, one substantially round object hangs by a second portion of the tether from a first side of the projecting appendage, and the other substantially round object hangs by a third portion of the tether from a second side of the projecting appendage.

In some embodiments, the projecting appendage is upwardly-angled relative to the substantially flat surface.

In some embodiments, the vertical body is a flat board.

In some embodiments, the vertical body is an elongated pole.

In some embodiments, the pair of substantially round objects joined together with a tether includes a common netting in which to receive the pair of substantially round objects therein, the netting also including a sheath configured to interpose the pair of substantially round objects and house excess netting material.

In some embodiments, the pair of substantially round objects joined together with a tether includes a chain coupled to each round object.

In some embodiments of the present general inventive concept, a gaming system includes a pair of substantially round objects tethered together but separated from one another, a means for tethering the pair of substantially round objects together, and a goal post to receive the pair of substantially round objects tethered together, the goal post including an upwardly-angled projecting appendage to allow the pair of substantially round objects tethered together to hang therefrom.

In some embodiments, the pair of substantially round objects tethered together includes a string having its ends coupled to each round object.

In some embodiments, the pair of substantially round objects tethered together includes a common netting in which to receive the pair of substantially round objects therein, the netting also including a sheath configured to interpose the pair of substantially round objects and house excess netting material.

In some embodiments, the pair of substantially round objects tethered together includes a chain coupled to each round object.

In some embodiments of the present general inventive concept, a game kit includes two balls joined together with a tether, a vertical body configured to stand upright on a substantially flat surface, and a projecting appendage disposed between a top and a bottom of said vertical body, said projecting appendage to receive the tether joining together the two balls, such that when said vertical body and said projecting appendage have received the tether joining together the two balls, a portion of the tether rests upon the projecting appendage, a first ball is disposed on a first side of the projecting appendage, and a second ball is disposed on a second side of the projecting appendage, said vertical body and said projecting appendage cooperatively forming a goal post.

In some embodiments, the projecting appendage is upwardly-angled relative to the substantially flat surface.

In some embodiments, the vertical body is a flat board.

In some embodiments, the vertical body is an elongated pole.

In some embodiments, the tether joining the balls includes a string having its ends coupled to each round object.

In some embodiments, balls joined together with a tether include a common netting in which to receive the pair of substantially round objects therein, the netting also including a sheath configured to interpose the pair of substantially round objects and house excess netting material.

In some embodiments, the tether joining the balls includes a chain coupled to each round object.

In some embodiments, when said projecting appendage has received the tether joining together the two balls, the balls and projecting appendage approximate the appearance of male genitalia.

BRIEF DESCRIPTION OF THE DRAWINGS

The following example embodiments are representative of example techniques and structures designed to carry out the features of the present general inventive concept, but the present general inventive concept is not limited to these example embodiments. Moreover, in the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Reference will now be made to example embodiments of the present general inventive concept, examples of which are illustrated in the accompanying drawings and illustrations. The example embodiments are described herein in order to explain the present general inventive concept by referring to the figures.

It is noted that the following detailed description may recite various descriptive terms such as horizontal, vertical, top, bottom, upward, downward, left, right, front, back, etc., when referring to the exemplary figures, but the present general inventive concept is not limited to any such terms or physical orientations. Such terms are used for convenience of description only, and could be reversed, modified, or interchanged without departing from the broader scope and spirit of the present general inventive concept.

Embodiments of the present general inventive concept provide a game whereby connected balls or like objects are placed or tossed on or at a goal post such that the resulting arrangement achieves a resemblance to male genitalia. In some example embodiments, two baseballs are tethered together using a string and separated from one another by a few inches. Generally, the goal post is a vertical structure configured to stand on the ground and including a projecting pole or like appendage angled upward and originating between the bottom and the top of the vertical structure. Competing participants attempt to position the tethered balls on the goal post such that they hang from the projecting post with one ball disposed on each side thereof. In some embodiments, the participants compete for possession of the tethered balls by, for example, wrestling in the mud or a like playing surface. Those of skill in the art, however, will recognize that the present general inventive concept may be played either outdoors or indoors. In some embodiments, participants compete by taking turns tossing the tethered balls at the goal post.

Figure 1:
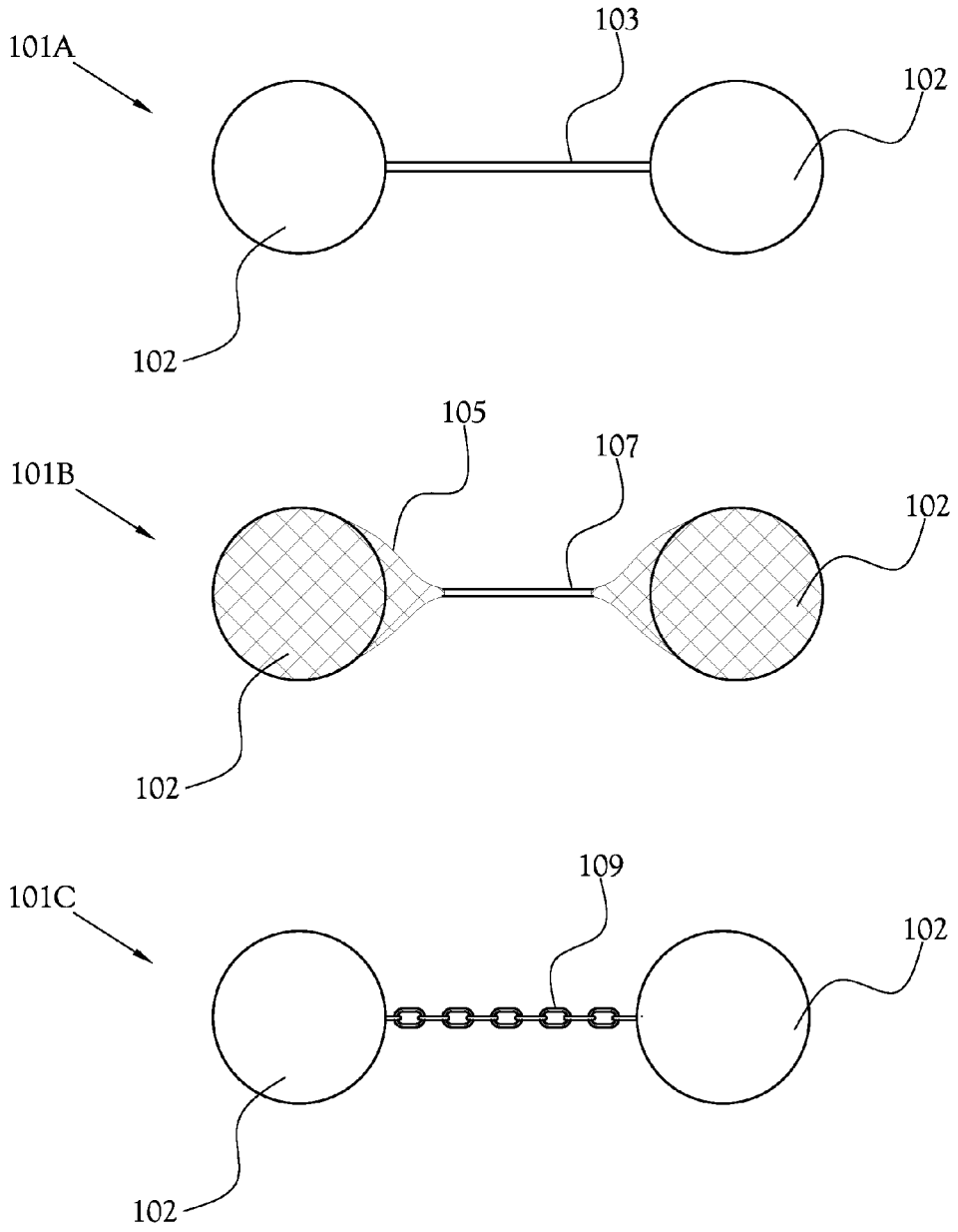
FIG. 1 illustrates various example embodiments of balls coupled to one another that are either placed on or tossed at a goal post.

FIG. 1 illustrates three example embodiment tethered, substantially round objects (e.g., balls) 101A, 101B, and 101C that are either placed on or tossed at a goal post. As illustrated, the balls 102 have been coupled together in three different ways. The example embodiment 101A illustrated at the top of the figure includes two balls 102 each connected to opposite ends of the same string 103. The opposing ends of the string 103 may be disposed all the way through each of the balls 102, or the ends may be secured to the outer surface of the balls 102, such as by using glue or a like connecting means.

The example embodiment 101B illustrated in the middle of FIG. 1 includes two balls 102 contained within a common netting 105. The balls 102 have been separated to the greatest extent permitted by the common netting 105, and a sheath 107 has been provided to the netting material 105 interposing the separated balls 102. This example embodiment permits the balls 102 to be tethered together without having to physically manipulate either of the balls 102, as they are simply placed inside the common netting 105.

Illustrated at the bottom of FIG. 1, the example embodiment 101C includes two balls 102 tethered together using a chain 109. Similar to the example embodiment illustrated at the top, the chain's 109 opposing ends have been provided to each of the balls 102 either by linking to a structure disposed inside or through the balls 102, or by coupling the chain 109 to the exterior surface of each of the balls 102.

Figure 2A:
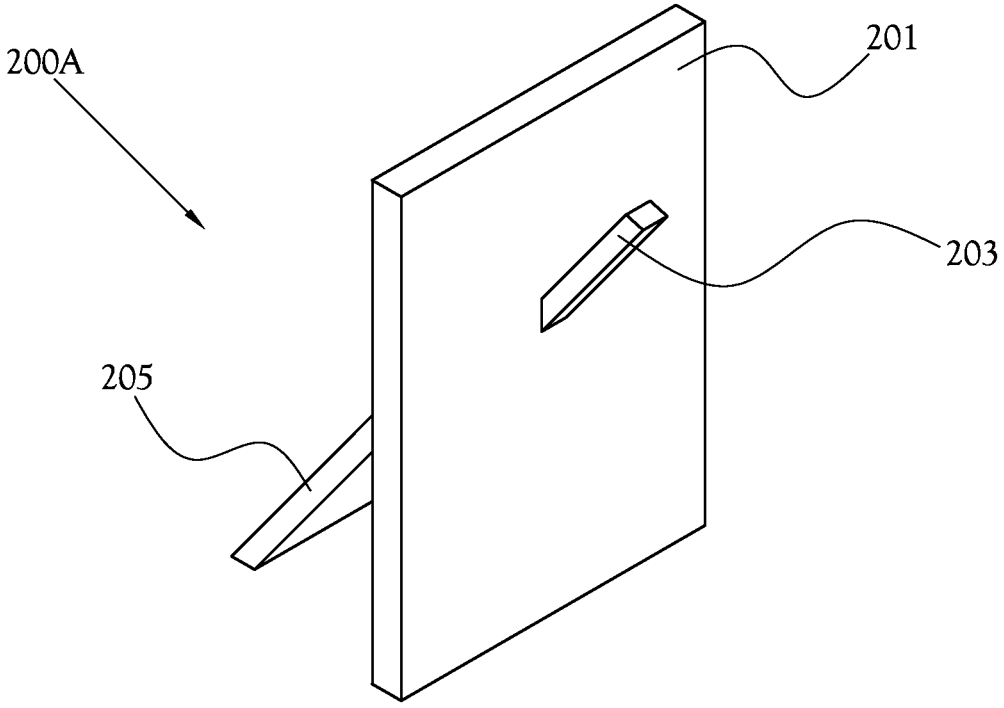
FIG. 2A illustrates an example embodiment goal post configured to receive the coupled spheres from FIG. 1.

FIG. 2A illustrates an example embodiment goal post 200A configured to receive the tethered balls 101 from FIG. 1. As illustrated, the goal post 200A of FIG. 2A includes a vertical body 201 in the form of a flat board. In some embodiments, the vertical body 201 includes a means for standing substantially upright, such as the pivoting stand structure 205 illustrated in FIG. 2A. In some embodiments, the vertical body 201 includes a means to mount it against a pre-existing wall, such as by using a hook and wire. The vertical body may also include décor, such as indicia of a professional sports team. Coupled to one face of the vertical body 201, at a predetermined location between the top and bottom of the vertical body 201, is an upwardly-angled post or appendage 203. The upwardly-angled posture of the appendage 203 achieves a hook-like arrangement to the vertical body 201, thereby being capable of receiving the tethered balls 101 thereon.

Figure 2B:
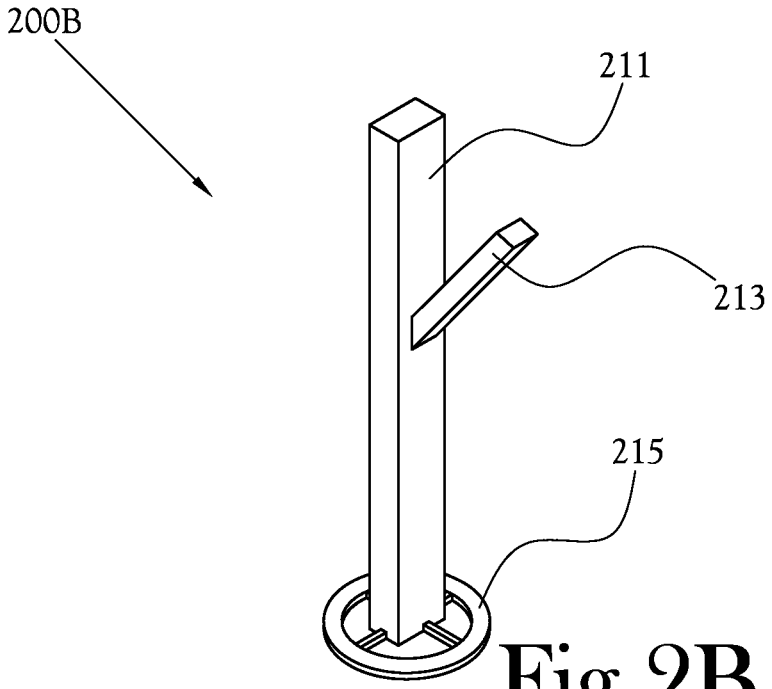
FIG. 2B illustrates another example embodiment goal post configured to receive the coupled spheres from FIG. 1.

FIG. 2B illustrates another example embodiment goal post 200B configured to receive the tethered balls 101 from FIG. 1. As illustrated, the goal post 200B of FIG. 2A includes a vertical body in the form of an elongated pole 211 configured to stand upright. In some embodiments, such as that illustrated in FIG. 2B, a circular base structure 215 is provided to the bottom of the vertical pole 211 as a means of enabling the vertical body 211 to stand substantially upright. In other embodiments, the vertical pole 211 is installed directly into the playing surface (e.g., the ground), such as by burying the lower end thereof. Similar to the example embodiment goal post from FIG. 2A, a upwardly-angled post or like appendage 213 is provided to the vertical body 211 at a predetermined location between the top and the bottom of the vertical body 211.

Figure 3:
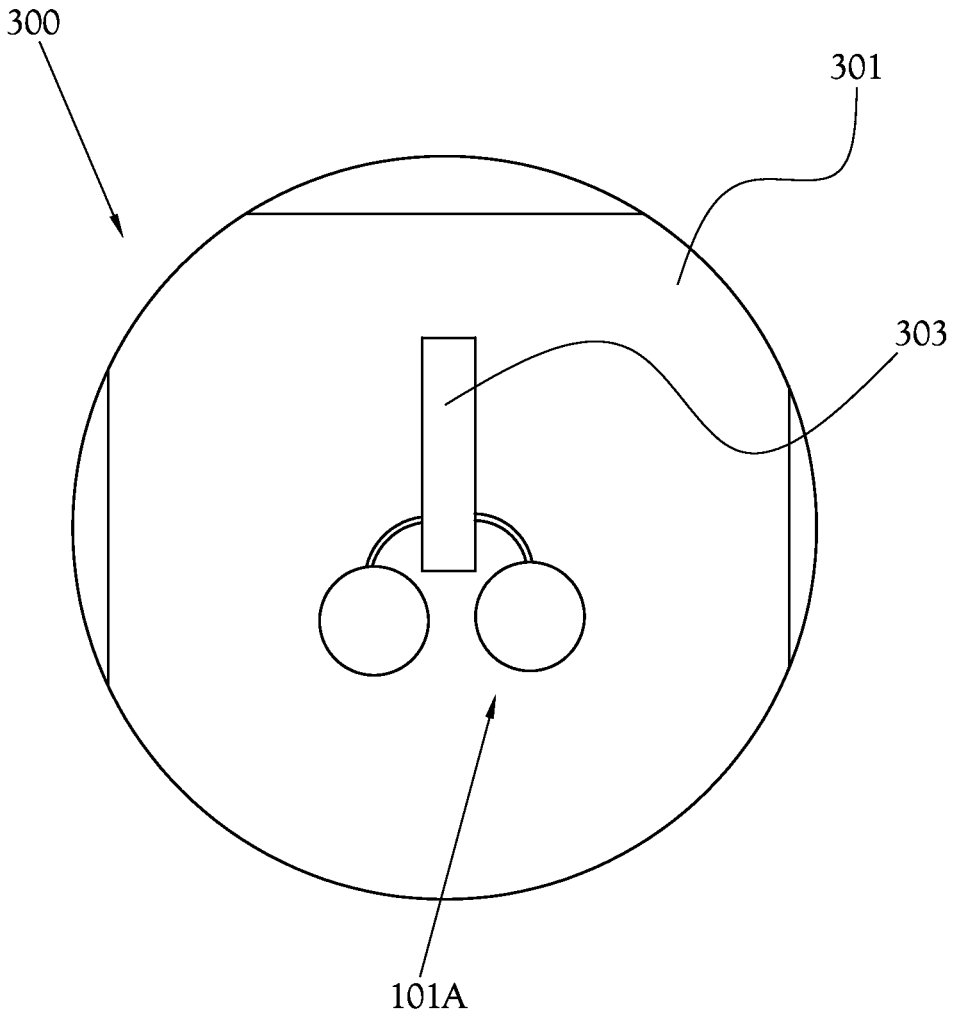
FIG. 3 illustrates yet another example embodiment goal post having the tethered balls from FIG. 1 disposed thereon.

FIG. 3 illustrates yet another example embodiment goal post 300 having the tethered balls 101A disposed on an upwardly-angled appendage 303. In the illustrated embodiment, the goal post 300 includes a substantially flat wall 301 having a projecting appendage 303 upwardly-angled and secured thereto. In some embodiments, the substantially flat wall 301 is a preexisting wall. As illustrated, the resulting arrangement resembles that of a male's genitalia, with the hanging, tethered balls 101A mimicking a pair of testicles and the appendage 303 mimicking a penis.

In some embodiments, the projecting appendage is configured to be releasably secured to the wall or vertical body. For example, the projecting appendage may include a base portion adapted to be fixed on a vertical wall having an upwardly-angled receiving slot to receive a projecting portion of the appendage.

In some embodiments, the projecting appendage is capable of pivoting about the vertical body. For instance, the upwardly-angled projecting appendage of the example embodiment goal posts from FIGS. 2A and 2B may be pivotably coupled to the vertical body such that it may pivot from a first position that is parallel to the vertical body to a second position, such as the upwardly-angled orientation presently illustrated.

In some embodiments of the present general inventive concept, a game is played by participants competing for possession of the tethered balls in a muddy field or like playing surface. Once one participant achieves possession of the tethered balls, he or she attempts to place the tethered balls on the goal post while the opposing participant tries to prevent the same. Once one participant has attained a particular score (e.g., two out of three), such as by successfully placing the tethered balls on the goal post a predetermined number of times, that participant wins.

In other embodiments of the present general inventive concept, participants compete against one another by taking turns tossing the tethered balls at the goal post. A successful toss results in the tethered balls achieving the arrangement illustrated in FIG. 3. Once a participant has successfully tossed the tethered balls at the goal post a predetermined number of times, that participant wins the game.

Still other embodiments will become readily apparent to those skilled in this art from reading the above-recited detailed description in view of all the drawings and figures. It is noted that the simplified diagrams and drawings do not illustrate all the various connections and assemblies of the various components, however, those skilled in the art will understand how to implement such connections and assemblies, based on the illustrated components, figures, and descriptions provided herein.

It is also noted that numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated. Accordingly, while the present general inventive concept has been illustrated by description of several example embodiments, it is not the intention of the applicant to restrict or in any way limit the scope of the inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings.

What is claimed is:

1. A game comprising:

a pair of substantially round objects joined together with a tether, wherein the pair of substantially round objects joined together with a tether includes a common netting in which to receive the pair of substantially round objects therein, the netting also including a sheath configured to interpose the pair of substantially round objects and house excess netting material;

a vertical body configured to stand upright on a substantially flat surface; and a projecting appendage disposed between a top and a bottom of said vertical body, said vertical body and said projecting appendage cooperating to receive the tether joining together the pair of substantially round objects, such that when said vertical body and said projecting appendage have received the tether joining together the pair of substantially round objects, a portion of the tether rests upon the projecting appendage, one substantially round object hangs by a second portion of the tether from a first side of the projecting appendage, and the other substantially round object hangs by a third portion of the tether from a second side of the projecting appendage.

2. The game of claim 1, wherein the projecting appendage is upwardly-angled relative to the substantially flat surface.

3. The game of claim 1, wherein the vertical body is a flat board.

4. The game of claim 1, wherein the vertical body is an elongated pole.

5. The game of claim 1, wherein the pair of substantially round objects joined together with a tether includes a string having its ends coupled to each round object.

6. The game of claim 1, wherein the pair of substantially round objects joined together with a tether includes a chain coupled to each round object.

7. A gaming system comprising:

a pair of substantially round objects tethered together but separated from one another, wherein the pair of substantially round objects tethered together includes a common netting in which to receive the pair of substantially round objects therein, the netting also including a sheath configured to interpose the pair of substantially round objects and house excess netting material;

a means for tethering the pair of substantially round objects together; and a goal post to receive the pair of substantially round objects tethered together, the goal post including an upwardly-angled projecting appendage to allow the pair of substantially round objects tethered together to hang therefrom.

8. The gaming system of claim 7, wherein the pair of substantially round objects tethered together includes a string having its ends coupled to each round object.

9. The gaming system of claim 7, wherein the pair of substantially round objects tethered together includes a chain coupled to each round object.

10. A game kit comprising:

two balls joined together with a tether, wherein said balls joined together with a tether include a common netting in which to receive the pair of substantially round objects therein, the netting also including a sheath configured to interpose the pair of substantially round objects and house excess netting material;

a vertical body configured to stand upright on a substantially flat surface; and a projecting appendage disposed between a top and a bottom of said vertical body, said projecting appendage to receive the tether joining together the two balls, such that when said projecting appendage has received the tether joining together the two balls, a portion of the tether rests upon the projecting appendage, a first ball is disposed on a first side of the projecting appendage, and a second ball is disposed on a second side of the projecting appendage;

said vertical body and said projecting appendage cooperatively forming a goal post.

11. The game kit of claim 10, wherein the projecting appendage is upwardly-angled relative to the substantially flat surface.

12. The game kit of claim 10, wherein the vertical body is a flat board.

13. The game kit of claim 10, wherein the vertical body is an elongated pole.

14. The game kit of claim 10, wherein the tether joining the balls includes a string having its ends coupled to each round object.

15. The game kit of claim 10, wherein the tether joining the balls includes a chain coupled to each round object.

16. The game kit of claim 10, wherein when said projecting appendage has received the tether joining together the two balls, the balls and projecting appendage approximate the appearance of male genitalia.

* * * * *